US009347617B2

(12) United States Patent
Aizawa et al.

(10) Patent No.: US 9,347,617 B2
(45) Date of Patent: May 24, 2016

(54) RESIDUAL RADIOACTIVE SLUDGE LIQUID SUCTION APPARATUS

(75) Inventors: Masahiro Aizawa, Chiyoda-ku (JP); Osamu Ogata, Chiyoda-ku (JP)

(73) Assignee: TAIHEI DENGYO KAISHA, LTD., Tokyo (JP)

( * ) Notice: Subject to any disclaimer, the term of this patent is extended or adjusted under 35 U.S.C. 154(b) by 468 days.

(21) Appl. No.: 13/807,835

(22) PCT Filed: Jun. 29, 2011

(86) PCT No.: PCT/JP2011/064889

§ 371 (c)(1), (2), (4) Date: Dec. 31, 2012

(87) PCT Pub. No.: WO2012/002419

PCT Pub. Date: Jan. 5, 2012

(65) Prior Publication Data

US 2013/0098483 A1 Apr. 25, 2013

(30) Foreign Application Priority Data

Jul. 1, 2010 (JP) ..... 2010-150758
Aug. 4, 2010 (JP) ..... 2010-175377

(51) Int. Cl.
*A47L 5/00* (2006.01)
*F17D 1/14* (2006.01)
(Continued)

(52) U.S. Cl.
CPC .. *F17D 1/14* (2013.01); *G21F 9/04* (2013.01); *G21F 9/22* (2013.01); *Y10T 137/86083* (2015.04)

(58) Field of Classification Search
CPC ..... G21F 9/22; G21C 19/02; B23D 21/04
USPC ..... 137/571; 15/1.7, 319, 327.3, 330
See application file for complete search history.

(56) References Cited

U.S. PATENT DOCUMENTS 3,170,276 A * 2/1965 Hall ..... 56/12.8
3,353,621 A * 11/1967 Clevett, Jr. ..... 180/124
(Continued)

FOREIGN PATENT DOCUMENTS

JP 05-317610 A 12/1993
JP 2000-065980 A 3/2000
(Continued)

OTHER PUBLICATIONS

International Search Report of PCT/JP2011/064889 dated Aug. 2, 2011.

*Primary Examiner* — Craig Schneider
*Assistant Examiner* — Angelisa L Hicks
(74) *Attorney, Agent, or Firm* — Sughrue Mion, PLLC

(57) ABSTRACT

There is provided a residual radioactive sludge liquid suction apparatus capable of safely and surely sucking radioactive sludge liquid remaining in a sludge storage tank with no fear of being exposed to radiation at a time when a small amount of sludge liquid remaining in the sludge storage tank is transferred to another tank. The suction apparatus is a residual radioactive sludge liquid suction apparatus used for sucking residual radioactive sludge liquid (L) at a time when the residual sludge liquid (L) remaining in a sludge storage tank T1 is transferred, and includes: a suction apparatus body 1; three hover skirts 2 mounted to the suction apparatus body 1; a suction head 8 mounted to the suction apparatus body 1 and configured to suck the residual sludge liquid (L); air jetting nozzles 13 mounted to the hover skirts 2, respectively; and an air supply source that supplies air to the hover skirts and the air jetting nozzles, wherein the suction apparatus body 1 floats on a surface of the residual sludge liquid (L) by supplying the air from the air supply source to the hover skirts, and moves on the surface of the residual sludge liquid (L) by jetting the air from the air supply source through the air jetting nozzles 13.

6 Claims, 8 Drawing Sheets

(51) Int. Cl.
*G21F 9/04* (2006.01)
*G21F 9/22* (2006.01)

(56) References Cited

U.S. PATENT DOCUMENTS 3,619,445 A * 11/1971 Carlson, Jr. ..... 264/565
4,041,965 A * 8/1977 Rosenberg ..... 134/167 R
4,245,455 A * 1/1981 Martin ..... 56/12.8
4,571,849 A * 2/1986 Gardner et al. ..... 34/79
5,048,275 A * 9/1991 Fassauer ..... 56/12.8
5,117,619 A * 6/1992 Fassauer ..... 56/128
5,311,727 A * 5/1994 Fassauer ..... 56/12.8
5,587,021 A * 12/1996 Hoersch et al. ..... 134/1
5,833,521 A * 11/1998 McPhee ..... B24C 3/06 451/101
6,520,449 B2 * 2/2003 Illingworth ..... 244/12.1
6,588,956 B1 * 7/2003 Gennuso, Jr. ..... 401/23
2005/0194196 A1 * 9/2005 Lee et al. ..... 180/117
2009/0090385 A1 * 4/2009 Vanderlinden ..... 134/6

FOREIGN PATENT DOCUMENTS

JP 2008-096116 A 4/2008
JP 4356728 B2 11/2009
JP 2012-013556 A 1/2012

* cited by examiner

RESIDUAL RADIOACTIVE SLUDGE LIQUID SUCTION APPARATUS

CROSS REFERENCE TO RELATED APPLICATIONS

This application is a National Stage of International Application No. PCT/JP2011/064889 filed Jun. 29, 2011, claiming priority based on Japanese Patent Application Nos. 2010-150758 filed Jul. 1, 2010 and JP 2010-175377 filed Aug. 4, 2010, the contents of all of which are incorporated herein by reference in their entirety.

FIELD OF THE INVENTION

The present invention relates to a residual radioactive sludge liquid suction apparatus, and more particularly, to a residual radioactive sludge liquid suction apparatus capable of safely and surely sucking radioactive sludge liquid (liquid sludge) in a sludge storage tank with no fear of being exposed to radiation at a time of transferring a small amount of sludge liquid contaminated by radioactive substance remaining in the sludge storage tank to another tank.

BACKGROUND TECHNOLOGY

A radioactive sludge contaminated by radioactive substance (called merely "sludge" hereinafter) composed of an ion exchange resin or filtration auxiliary agent and the like, which may be generated according to the operation (i.e., running) of a nuclear power plant, is stored for a certain predetermined time in a sludge storage tank together with supernatant solution for attenuating radiation, thereafter, taken out from the sludge storage tank, and then, transferred to and treated at a processing section.

Further, the supernatant solution is generated by a reason such that when the sludge is transferred to the storage tank, it is impossible to transfer the sludge on its own, so that it is necessary to transfer the sludge as sludge liquid having fluidity by being mixed with water or like. When the thus formed sludge liquid is transferred to the storage tank, the sludge is precipitated downward in the storage tank, and hence, the supernatant solution is generated above the precipitated sludge.

It is required for such sludge storage tank to have high reliability, and accordingly, the sludge storage tank is periodically inspected and repaired as occasion demands. In order to carry out the inspection of the sludge storage tank, it is necessary to empty the sludge storage tank, which requires for the stored sludge to be transferred or delivered into another tank. However, it is an essential requirement that such transferring working should be performed under the condition of most-reduced exposure of radiation to workers.

One example of a radioactive sludge transferring apparatus for solving the above inevitable problem is disclosed in Patent Document 1 (Japanese Patent Publication No. 4356728). Hereunder, this radioactive sludge transferring apparatus disclosed in the above publication will be mentioned as "conventional transfer system" and explained with reference to a drawing.

FIG. 14 is a schematic diagram showing an entire structure of the conventional transfer system.

With reference to FIG. 14, reference character T1 denotes a sludge storage tank in which sludge 41 is stored, reference character T2 denotes a transfer tank into which the sludge 41 stored in the sludge storage tank T1 is transferred, reference numeral 42 is supernatant solution of the sludge 41, and reference numeral 43 is an air blowing device including an air supply source 44, an air pipe 45 and an air nozzle 46. The air-blowing device 43 injects air to the supernatant solution of the sludge 41 stored in the sludge storage tank T1 to thereby locally stir the supernatant solution 42, thus generating a sludge liquid 47 having fluidity.

With also reference to FIG. 14, reference character P1 denotes a sludge transfer pump, reference character P2 is a supernatant solution return pump disposed inside the transfer tank T2, reference numeral 48 is a sludge liquid transfer path connecting the sludge transfer pump P1 and the transfer tank T2, reference numeral 49 is a supernatant solution transfer path connected to the supernatant solution return pump P2, and reference numeral 50 is a supernatant solution jetting device connecting to the supernatant solution transfer path 49. The supernatant solution jetting device 50 acts to spray or jet the supernatant solution 42, as highly pressurized water jet, from the supernatant solution transfer path 49 toward the sludge 41 stored in the sludge storage tank T1 through a supernatant solution jetting nozzle 52 mounted to a supernatant solution pipe 51.

The above-mentioned air pipe 45, the sludge solution transfer path 48, the supernatant solution transfer path 49 and the supernatant solution pipe 51 are set into the sludge storage tank T1 or the transfer tank T2 through inspection holes 53 which are shielded by radiation shielding means 54, respectively.

Further, reference numeral 55 denotes a monitoring camera set to the sludge storage tank T1 so as to monitor the condition such as sludge liquid forming state or process inside the sludge storage tank T1. Reference numeral 56 is a monitoring camera set inside the transfer tank T2 so as to monitor the condition such as supernatant solution forming state or process inside the transfer tank T2. Reference numeral 57 is a control device that controls, in accordance with image information from the monitoring cameras 55 and 56, a series of sludge transferring operations by operating valves B1 to B4 mounted to the air-blowing device 43, the supernatant solution jetting device 50, the sludge liquid transfer path 48 and the supernatant solution transfer path 49.

According to the conventional transfer system, the sludge 41 stored in the sludge storage tank T1 is transferred to the transfer tank T2 in a manner mentioned hereunder.

First, air is blown into the supernatant solution in the sludge storage tank T1 by means of the air blowing device 43 to thereby locally stir the supernatant solution. According to this operation, the sludge 41 stored in the sludge storage tank T1 is crushed and a sludge liquid 47 having fluidity is thereby formed on the sludge 41.

When the sludge liquid 47 is formed inside the sludge storage tank T1 by the manner mentioned above, the sludge liquid 47 is sucked by the sludge transfer pump P1 and then transferred to the transfer tank T2 through the sludge liquid transfer path 48. The sludge liquid (solution) 47 transferred into the transfer tank T2 is separated into the sludge 41 and the supernatant solution 42 according to the time elapsed.

According to the operation mentioned above, when the supernatant solution 42 fills the inside of the transfer tank T2, the supernatant solution 42 is sucked by the supernatant solution return pump P2 and transfer the same 42 to the supernatant solution jetting device 50 through the supernatant solution transfer path 49. The supernatant solution jetting device 50 acts to jet or spray the supernatant solution 42 onto the sludge 41 stored in the sludge storage tank T1 through the supernatant solution jetting nozzle 52 via the supernatant solution pipe 51. Thus, the sludge 41 is crushed and the sludge liquid having fluidity 47 is formed.

Thereafter, the sludge liquid 47 in the sludge storage tank T1 is sucked again by the sludge transfer pump P1 and then transferred to the transfer tank T2 through the sludge transfer path 48. Then, the supernatant solution 42 in the transfer tank T2 is jetted or blown to the sludge 41 stored in the sludge storage tank T1.

By repeating the above operation or working, the sludge 41 stored in the sludge storage tank T1 can be transferred to the transfer tank T2.

PRIOR ART DOCUMENT

Patent Document

Patent Document 1: Japanese Patent Publication No. 4356728

DISCLOSURE OF THE INVENTION

Problems to be Solved by the Invention

As described above, the conventional transfer device provides the following advantageous effects.

(1) Since a series of sludge 41 transfer operation can be performed by remote control operation by the control device 57 in accordance with information images or like from the monitoring cameras 55 and 56, exposure amount of radiation to an operator can be maximally reduced.

(2) In a case where it is required to crush the sludge 41 finely by means of highly pressurized water jet, the sludge 41 can be surely crushed. Further, the crushing of the sludge 41 is initially performed by blasting air to the sludge 41.

(3) Since, as the highly pressurized water usable for crushing the sludge 41, the supernatant solution 42 initially stored in the sludge storage tank T1 is used, an amount of radioactive disposal does not increase, and on the contrary, in a case when an external water is used, an amount of radioactive disposal will be increased correspondingly.

However, against the above advantageous effects, the conventional transfer device provides the following defects or disadvantages.

According to the conventional transfer device, although it is possible to transfer all amount of the sludge 41 stored in the sludge storage tank T1 to the transfer tank T2, a few amount of sludge liquid 47 inevitably remains in the sludge storage tank T1 in view of essential performance of the sludge transfer pump P1.

Since the transferring working of the residual sludge liquid has been performed by manual operation, there remains fear of being exposed to radiation for the operator.

Accordingly, an object of the present invention is to provide a residual radioactive sludge liquid suction apparatus capable of safely and surely sucking residual sludge remaining in the sludge storage tank with no fear of being exposed to radiation through a remote control operation at a time when a small amount of sludge remaining in the sludge storage tank is transferred to another tank, which may occur inevitably on sludge transfer pump performance.

Means for Solving the Problems

The present invention was conceived to achieve the above object and attains the following characteristic features.

[1] The present invention provides a residual radioactive sludge liquid suction apparatus that sucks residual sludge liquid at a time when the residual sludge liquid remaining in one tank is transferred to another tank, and the residual radioactive sludge liquid suction apparatus includes: a suction apparatus body; a plurality of hover skirts mounted to the suction apparatus body; a suction head mounted to the suction apparatus body and configured to suck the residual sludge liquid; air jetting nozzles mounted to the hover skirts, respectively; and an air supply source that supplies air to the hover skirts and the air jetting nozzles, wherein the suction apparatus body floats on a surface of the residual sludge liquid by supplying the air from the air supply source to the hover skirts, and moves on the surface of the residual sludge liquid by jetting the air from the air supply source through the air jetting nozzles.

[2] In the residual radioactive sludge liquid suction apparatus according to the above [1], the hover skirts are inclined toward the suction head side.

[3] In the residual radioactive sludge liquid suction apparatus according to the above [1] or [2], the suction head is vertically movable.

[4] In the residual radioactive sludge liquid suction apparatus according to any one of the above [1] to [3], a plurality of the hover skirts includes at least three hover skirts that are arranged to apexes constituting a polygonal shape, and the suction head is surrounded by the at least three hover skirts.

[5] The present invention provides a residual radioactive sludge liquid suction apparatus that sucks residual sludge liquid at a time when the residual sludge liquid remaining in one tank is transferred to another tank, and the suction apparatus includes: a suction apparatus body; a plurality of floating bodies mounted to the suction apparatus body; a suction head mounted to the suction apparatus body and configured to suck the residual sludge liquid; air jetting nozzles mounted to the floating bodies, respectively; and an air supply source that supplies air to the air jetting nozzles, wherein the suction apparatus body floats on a surface of the residual sludge liquid by floating force of the floating bodies, and moves on the surface of the residual sludge liquid by jetting the air from the air supply source through the air jetting nozzles.

[6] In the residual radioactive sludge liquid suction apparatus according to the above [5], each of the floating bodies comprises a ring-shaped air tube and a floating member provided in a space surrounded by the ring-shaped air tube.

[7] In the residual radioactive sludge liquid suction apparatus according to the above [5] or [6], the floating member is made of foamed polystyrene.

[8] In the residual radioactive sludge liquid suction apparatus according to the above [5] or [7], the suction head is vertically movable.

[9] In the residual radioactive sludge liquid apparatus according to any one of the above [5] to [8], wherein a plurality of the floating bodies includes at least three floating bodies that are arranged to apexes constituting a polygonal shape, and the suction head is surrounded by the at least three floating bodies.

Effects of the Invention

According to the present invention, at a time when a small amount of the sludge liquid remaining in the sludge storage tank is transferred to another tank, the sludge liquid in the sludge storage tank can be sucked safely and surely with no fear to being exposed to radiation.

MODE FOR EMBODYING THE INVENTION

One embodiment (mode) of a residual radioactive sludge suction apparatus according to the present invention will be described hereunder with reference to the accompanying drawings.

Figure 1:
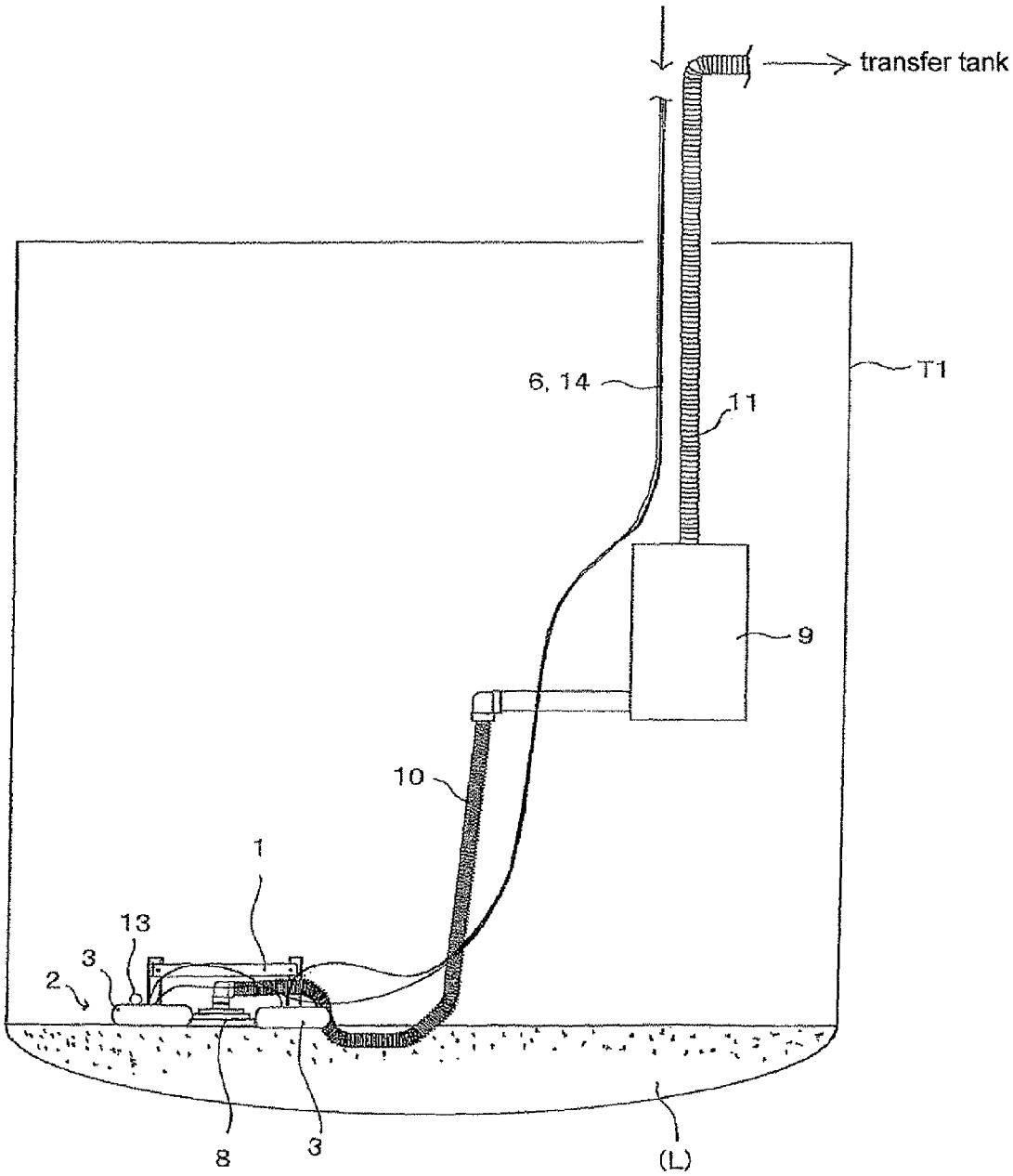
FIG. 1 is an illustration for explaining sludge liquid sucking operation by using a residual radioactive sludge liquid suction apparatus according to one embodiment of the present invention.
Figure 2:
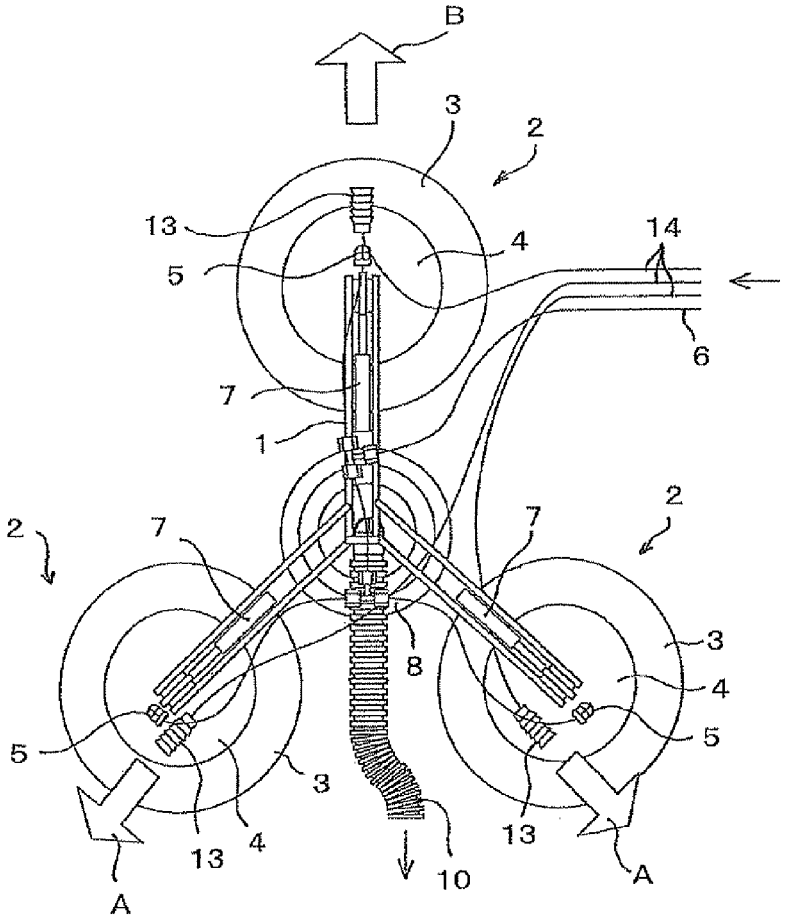
FIG. 2 is an illustrated plan view showing the residual radioactive sludge suction apparatus according to the present invention.
Figure 3:
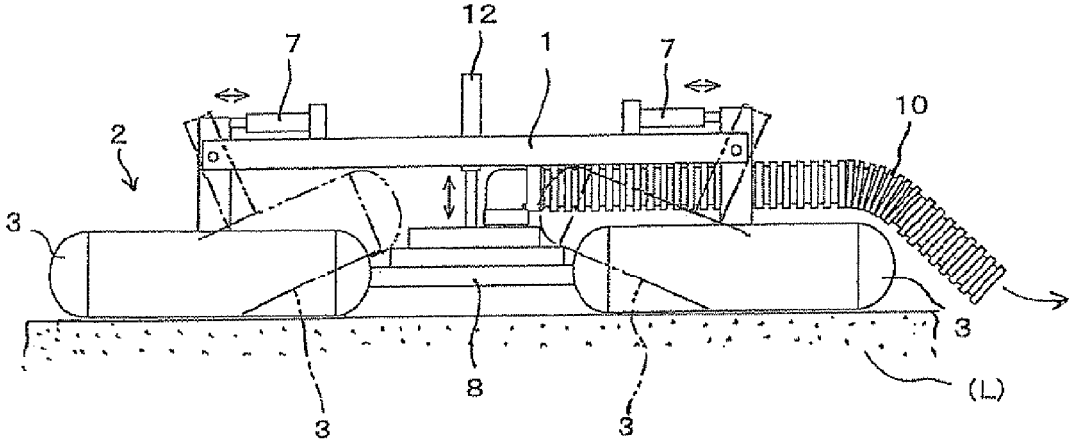
FIG. 3 illustrates a front view of the residual radioactive sludge suction apparatus according to the present invention.
Figure 4:
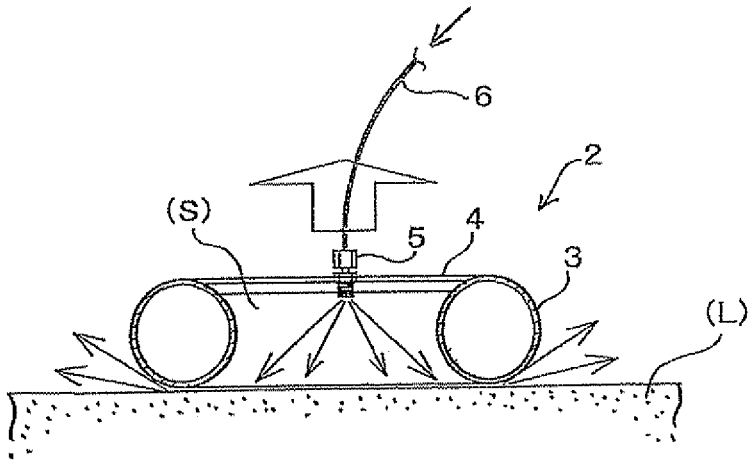
FIG. 4 is a view explaining function of a hover skirt (hovercraft skirt) of the residual radioactive sludge suction apparatus according to the present invention.

FIG. 1 is an illustration for explaining sludge liquid sucking operation by using a residual radioactive sludge liquid suction apparatus according to the present invention, FIG. 2 is an illustrated plan view showing the residual radioactive sludge suction apparatus according to the present invention, FIG. 3 illustrates a front view of the residual radioactive sludge suction apparatus according to the present invention, and FIG. 4 is a view explaining function of a hover skirt (hovercraft skirt) of the residual radioactive sludge suction apparatus according to the present invention.

Figure 14:
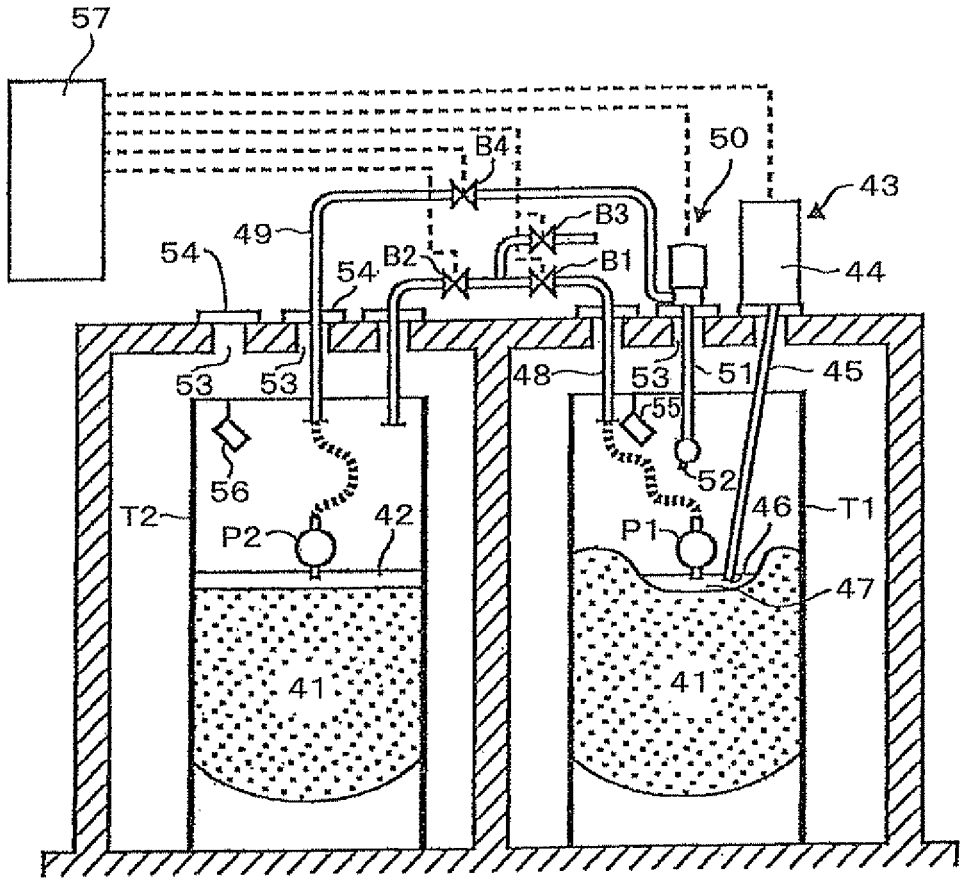
FIG. 14 is a schematic diagram representing a conventional transfer device.

With reference to FIGS. 1 to 4, reference character T1 denotes a sludge storage tank as one tank. In the sludge storage tank T1, there remains a small amount of sludge liquid after the transfer of the sludge from the sludge storage tank T1 to a transfer tank as another tank, not shown, (for example, conventional transfer tank). Such remaining liquid is called residual sludge liquid (L) hereinafter. The residual sludge liquid (L) includes a case where only the supernatant solution remains on the sludge (see FIG. 14).

Reference numeral 1 denotes a suction apparatus body, 2 is a plurality of hover skirts mounted horizontally to the suction apparatus body 1. In the described embodiment, three hover skirts 2 are shown at apexes in a triangular-shape arrangement. The number of the hover skirt is however not limited to three.

Each of the hover skirts 2 is composed of, as shown in FIG. 4, a ring-shaped rubber tube 3 and a flat plate 4 closing the upper portion of the ring-shaped rubber tube 3. A plug 5 to which an air tube 6 is connected is provided for the flat plate 4. The rubber tube 3 and the flat plate 4 define an inner space (S), into which air from an air supply source, not shown, disposed outside the sludge storage tank T1 is supplied through the air tube 6. As shown in FIG. 4, when the air is supplied into the inner space (S) of the rubber tube 3, the suction apparatus body 1 is moved upward and floated from the liquid surface of the residual sludge liquid (L) in accordance with the principle of hovercraft as shown with arrows.

The hover skirts 2 are inclined toward the suction head (mentioned herein later) side from cylinders 7 as shown in FIG. 3 with two-dot-chain lines. The cylinders 7 are remotely operated by air supplied from the air supply source. The reason why the hover skirts are inclinable resides in that when the air is supplied into the inner spaces of the hover skirts 2 under the hover skirts 2 being inclined towards the suction head, the residual sludge liquid (L), of which surface level is further lowered, is gathered on the suction head side, thereby easily and surely sucking the remaining small amount of the residual sludge liquid (L).

Reference numeral 8 denotes a suction head that is mounted to the suction apparatus body 1 so as to be surrounded by the three hover skirts 2 positioned at the apex portions of the triangular arrangement thereof. The suction head 8 is connected to a suction pump 9 suspended inside the sludge storage tank T1 by means of a suction pipe 10 (refer to FIG. 1). The residual sludge liquid (L) sucked by the suction pump 9 is transferred to the transfer tank, described hereinbefore, through a transfer pipe 11. The suction head 8 is vertically movable capable of adjusting, by a cylinder 12, the sucking height thereof with respect to the suction apparatus body 1. The cylinder 12 is remotely operated by the air supplied from the air supply source.

Further, it is to be noted that the number of the hover skirt 2 is not limited to three and other number of hover skirts may be arranged to apexes (apex points) of polygonal arrangement thereof.

Reference numeral 13 denotes an air jetting nozzle provided for each of the hover skirts 2. The air jetting nozzles 13 are connected independently to the air supply source through air tubes 14, respectively. By supplying the air to the air jetting nozzles 13 in the floating state of the suction apparatus body 1, the suction apparatus body 1 moves freely on the residual sludge liquid (L). For example, as shown in FIG. 2, the air is supplied to the air jetting nozzles 13 mounted to two hover skirts 2 (lower ones in FIG. 2) and jetted in a direction of arrows A, the suction apparatus body 1 is moved forward in a direction of an arrow B. The air supply to the air jetting nozzles 13 is remotely controlled.

According to the residual radioactive sludge suction apparatus of the present invention of the structure mentioned above, the residual sludge liquid (L) remaining in the sludge storage tank T1 is sucked and transferred into the transfer tank, not shown, in the manner mentioned hereunder.

As shown in FIG. 1, the suction pump 9 is disposed in a state suspended into the sludge storage tank T1, and the residual radioactive sludge liquid suction apparatus according to the present invention is lowered into the sludge storage tank T1 on the surface residual sludge (L) stored on the bottom thereof. In this state, the suction head 8 and the suction pump 9 are connected by means of the suction pipe 10, and on the other hand, the suction pump 9 and the transfer tank are connected by means of the transfer pipe 11.

Figure 5:
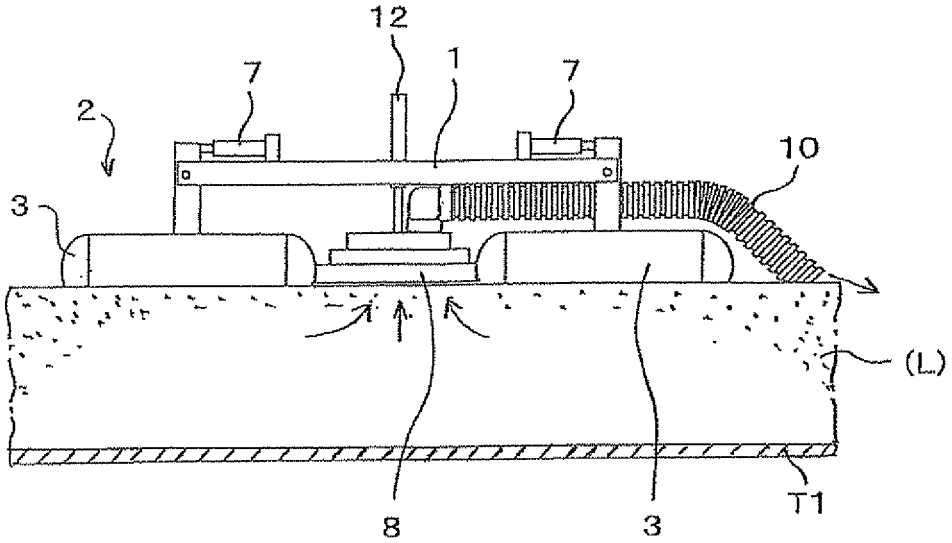
FIG. 5 illustrates a front view showing a state of sucking the sludge liquid by lifting upward the suction head of the residual radioactive sludge suction apparatus according to the present invention above the sludge liquid surface.

Then, as shown in FIG. 5, the suction pump 9 is operated under the state in which the residual radioactive sludge liquid suction apparatus is floated above the surface of the residual sludge liquid (L) by the operation of the hover skirts 2, thereby sucking the residual sludge liquid (L). The sucked residual sludge liquid (L) is transferred to the transfer tank through the transfer pipe 11.

When it is required to change the sucking position of the residual sludge liquid (L), air is supplied to the inside spaces (S) of the hover skirts 2 to thereby float the residual radioactive sludge liquid suction apparatus from the surface of the residual sludge liquid (L). Under the state, the air is supplied to the air jetting nozzles 13, thus moving the residual radioactive sludge liquid suction apparatus to an optional position. The reason why the residual radioactive sludge suction apparatus is moved resides in that the residual sludge liquid (L) has generally high density, and hence, there may cause a case of being difficult to smoothly suck all the residual sludge liquid (L) on the bottom of the sludge storage tank T1 when the sucking operation is performed only at one position.

After moving the residual radioactive sludge liquid suction apparatus to a desired position, the residual sludge liquid (L) sucking operation as mentioned above will be repeatedly performed by operating the suction pump 9.

Figure 6:
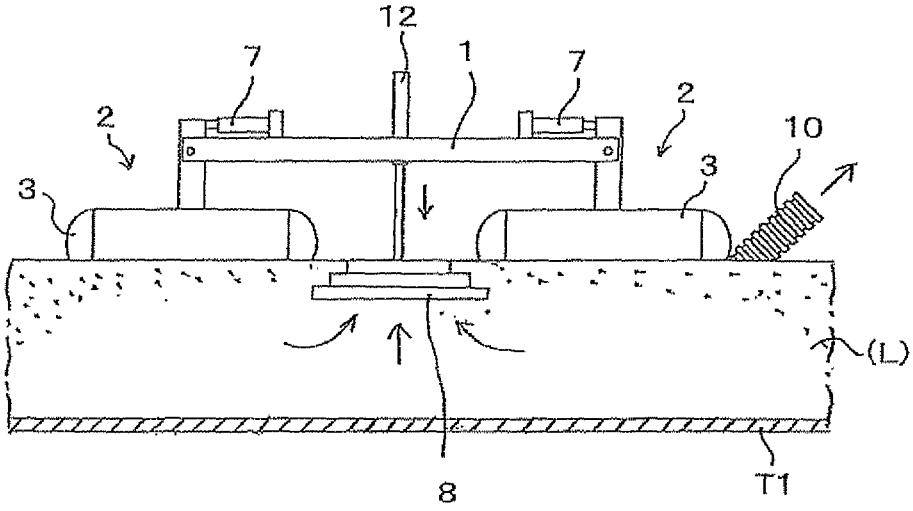
FIG. 6 illustrates a front view showing a state of sucking the sludge liquid by lowering the suction head of the residual radioactive sludge suction apparatus according to the present invention within the sludge liquid.

As mentioned above, as the residual sludge liquid (L) is sucked, the surface level of the residual sludge liquid (L) lowers, and according to the lowering of the sludge liquid surface, as shown in FIG. 6, the cylinder 12 is actuated to lower the suction head 8. Further, even in a case where the sludge liquid surface has a high level, when the residual sludge liquid (L) below the liquid surface is selectively sucked, the suction head 8 is lowered.

Figure 7:
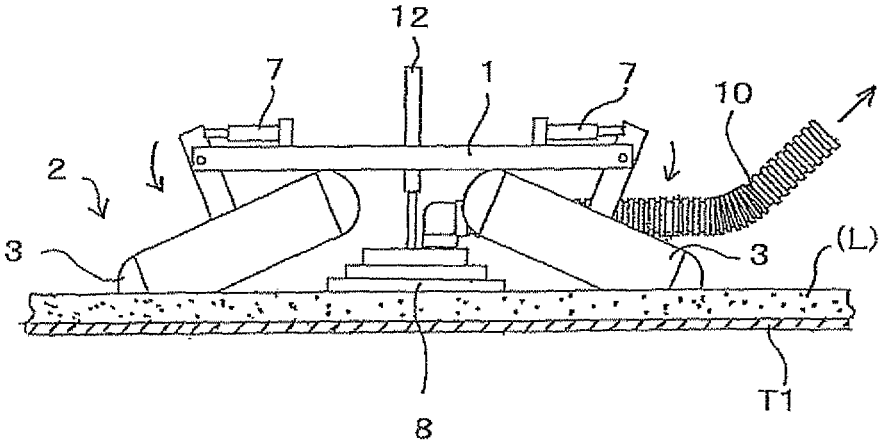
FIG. 7 illustrates a front view showing a state of sucking the sludge liquid by inclining a hover skirt of the residual radioactive sludge suction apparatus according to the present invention on the suction head side.

As the residual sludge liquid (L) is sucked, the liquid surface level lowers, and it becomes difficult to continuously suck the residual sludge liquid. In such case, as shown in FIG. 7, the cylinders 7 are actuated to tilt the hover skirts 2 to the suction head (8) side, and in this state, the air is supplied into the inside spaces (S) of the hover skirts 2. Thus, the residual sludge liquid (L) of which the surface level is lowered is gathered on the suction head (8) side, so that the remaining small amount of the residual sludge liquid (L) can be surely sucked.

Further, the air supply into the inside spaces (S) of the hover skirts 2 causes the sludge precipitated on the bottom of the sludge tank T1 to stir, as a result, the residual sludge liquid (L) can be further effectively sucked. Even in such manner, if the sludge precipitated on the bottom of the sludge storage tank T1 is not stirred, a water supply nozzle, not shown, may be inserted into the sludge storage tank T1 to jet the water toward the sludge for forcibly stirring the sludge.

Further, in a case where a certain amount of residual sludge liquid (L) remains, the hover skirts 2 are tilted from the state in which the residual radioactive sludge liquid suction apparatus floats on the liquid surface to release the air in the spaces (S) inside the hover skirts 2, and then, the suction apparatus loses its floating function and dips into the sludge liquid (L). As a result, the suction head 8 approaches the bottom of the sludge storage tank T1. Accordingly, the residual sludge liquid (L) on the bottom of the sludge storage tank T1 can be surely sucked.

In the above operation, the movement of the residual radioactive sludge liquid suction apparatus may be performed by jetting air though the air jetting nozzles 13 with the state being maintained, or may performed after the suction apparatus is once moved upward on the liquid surface.

All the above mentioned operations will be performed by remote control or remote operate manner.

According to the residual radioactive sludge liquid suction apparatus of the present invention of the structures or configurations mentioned above, the residual sludge liquid (L) in the sludge storage tank T1 is sucked and transferred into the transfer tank, not shown, safely and surely with no fear of being exposed to radiation.

Next, one exemplary embodiment of the residual radioactive sludge liquid suction apparatus according to another embodiment of the present invention will be described with reference to the drawings.

Figure 8:
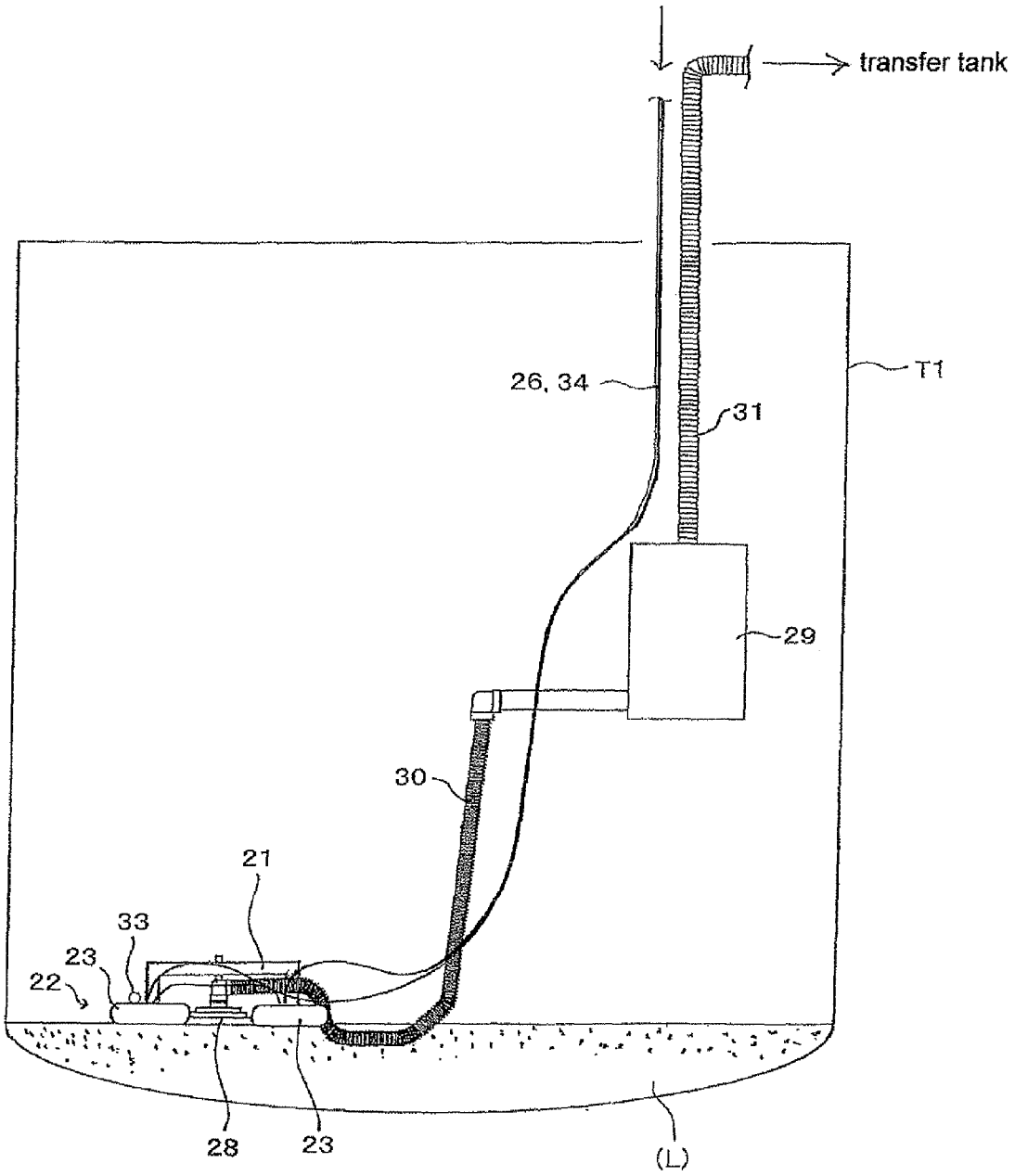
FIG. 8 is an illustration for explaining sludge liquid sucking operation by using a residual radioactive sludge liquid suction apparatus according to another embodiment of the present invention.
Figure 9:
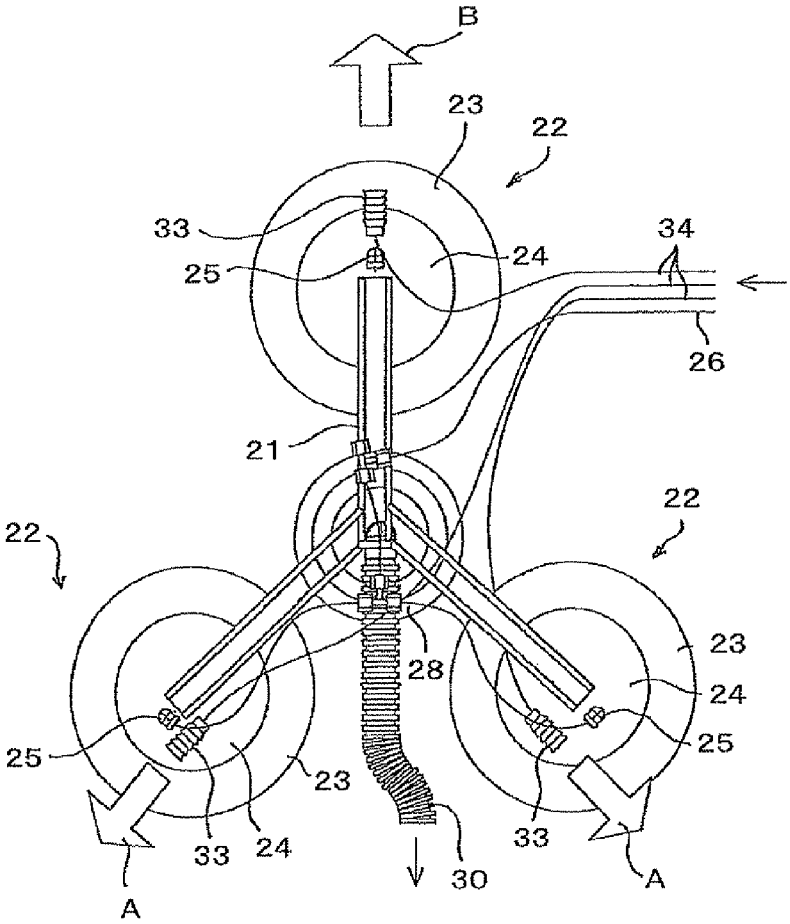
FIG. 9 is an illustrated plan view showing the residual radioactive sludge suction apparatus according to the other embodiment of the present invention.
Figure 10:
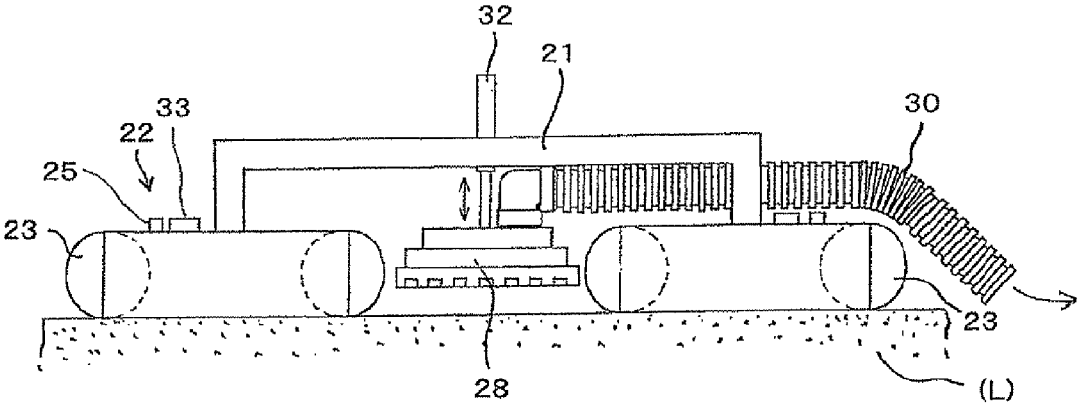
FIG. 10 illustrates a front view of the residual radioactive sludge suction apparatus according to the other embodiment of the present invention.
Figure 11:
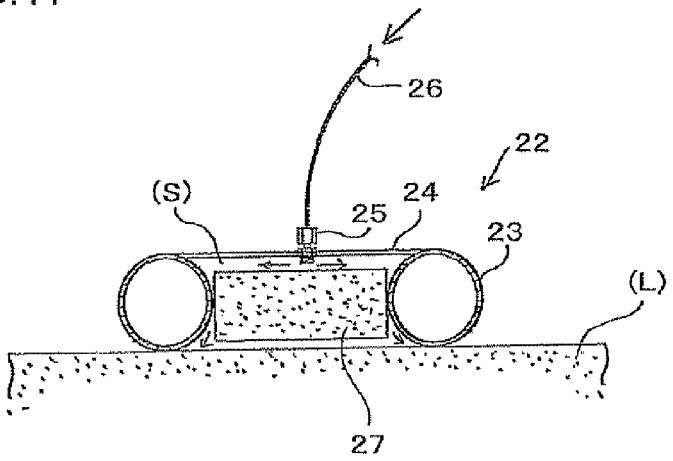
FIG. 11 is a view explaining function of a floating body of the residual radioactive sludge suction apparatus according to the other embodiment of the present invention.

FIG. 8 is an illustration for explaining sludge liquid sucking operation by using a residual radioactive sludge liquid suction apparatus according to another embodiment of the present invention, FIG. 9 is an illustrated plan view showing the residual radioactive sludge suction apparatus according to the other embodiment of the present invention, FIG. 10 illustrates a front view of the residual radioactive sludge suction apparatus according to the other embodiment of the present invention, and FIG. 11 is a view explaining function of a floating body of the residual radioactive sludge suction apparatus according to the other embodiment of the present invention.

With reference to FIG. 8 to FIG. 11, reference character T1 denotes a sludge storage tank as one tank. In the sludge storage tank T1, there remains a small amount of sludge liquid after the transfer of the sludge from the sludge storage tank T1 to a transfer tank as another tank, not shown, (for example, one corresponding to conventional transfer tank). Such remaining liquid is called residual sludge liquid (L) hereinafter. The residual sludge liquid (L) includes a case of only remaining the supernatant solution on the sludge (see FIG. 14).

Reference numeral 21 denotes a suction apparatus body, 22 is a plurality of floating bodies mounted horizontally to the suction apparatus body 21. In the described embodiment, three floating bodies 22 are shown at apex portions (apexes) in a triangular arrangement. The number of the floating body is however not limited to three and may be arranged to respective apexes of polygonal arrangement.

Each of the floating bodies 22 is composed of, as shown in FIG. 11, a ring-shaped rubber tube 23 filled up with air, a closing plate 24 closing an upper opening of the ring-shaped rubber tube 23, and a floating member 27, such as foamed polystyrene, disposed inside a space (S) defined by the rubber tube and the closing plate 24. A plug 25 to which an air tube 26 is connected is provided for the closing plate 24. Into the space (S), air from an air supply source, not shown, disposed outside the sludge storage tank T1 is supplied through the air tube 26. The air supplied in the space (S) is discharged as air bubbles from the lower portion of the floating body 22 through a gap between the rubber tube 23 and the floating member 27, thereby achieving balance adjustment of the suction apparatus body 21.

Reference numeral 28 denotes a suction head for sucking the residual sludge liquid (L), which is mounted to the suction apparatus body 21 so as to be surrounded by three floating bodies 22 arranged at apexes of the triangular shape. The suction head 28 is connected to a suction pump 29 suspended inside the sludge storage tank T1 by means of a suction pipe 30. The residual sludge liquid (L) sucked by the suction pump 29 is transferred to the transfer tank mentioned above through the transfer pipe 31. The suction head 28 is vertically movable for adjusting the sludge liquid sucking height with respect to the suction apparatus body 21 by means of cylinder 32. The cylinder 32 is remotely operated by means of air supplied from the air supply source. The suction head 28 is lowered to reach the bottom of the sludge storage tank T1 by the actuation of the cylinder 32, where the position of the suction head 28 by the suction apparatus body 21 is secured.

Reference numeral 33 denotes an air jetting nozzle provided for each of the floating bodies 22. The air jetting nozzles 33 are connected independently to the air supply source through air tubes 34, respectively. By supplying the air to the air jetting nozzles 33 in the floating state of the suction apparatus body 21, the suction apparatus body 21 moves freely on the residual sludge liquid (L). For example, as shown in FIG. 9, air is supplied to the air jetting nozzles 33 mounted to two floating bodies 22 (lower ones in FIG. 2) and jetted in a direction of arrows A, the suction apparatus body 21 is moved forward in a direction of an arrow B. The air supply to the air jetting nozzles 33 is remotely controlled.

According to the other residual radioactive sludge suction apparatus according to the present invention of the structure mentioned above, the residual sludge liquid (L) remaining in the sludge storage tank T1 is sucked and transferred into the transfer tank, not shown, in the manner mentioned hereunder.

As shown in FIG. 8, the suction pump 29 is disposed in a state suspended into the sludge storage tank T1, and the residual radioactive sludge liquid suction apparatus according to the other embodiment of the present invention is lowered into the sludge storage tank T1 on the surface residual sludge (L) stored on the bottom thereof. In this state, the suction head 28 and the suction pump 29 are connected by means of the suction pipe 30, and on the other hand, the suction pump 29 and the transfer tank are connected by means of the transfer pipe 31.

Figure 12:
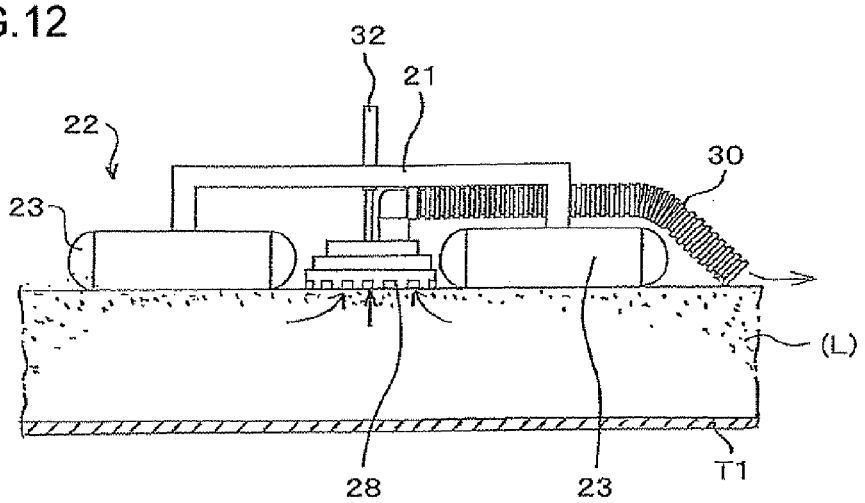
FIG. 12 illustrates a front view showing a state of sucking the sludge liquid by lifting upward the suction head of the residual radioactive sludge suction apparatus according to the other embodiment of the present invention above the sludge liquid surface.

Then, as shown in FIG. 12, the suction pump 29 is operated under the state in which the residual radioactive sludge liquid suction apparatus is floated above the residual sludge liquid (L) by the floating bodies 22, thereby sucking the residual sludge liquid (L). The sucked residual sludge liquid (L) is transferred to the transfer tank through the transfer pipe 31.

When it is required to change the sucking position of the residual sludge liquid (L), the air is jetted from a desired air jetting nozzle 33, thereby moving the residual radioactive sludge liquid suction apparatus to an optional position. The reason why the residual radioactive sludge suction apparatus is moved resides in that the residual sludge liquid (L) has, in a certain case, high density, and hence, there may cause a case of being difficult to smoothly suck all the residual sludge liquid (L) on the bottom of the sludge storage tank T1 when the sucking operation is performed only at one position.

After moving the residual radioactive sludge liquid suction apparatus to a desired position, the residual sludge liquid (L) sucking operation as mentioned above will be performed by operating the suction pump 29 in the manner mentioned hereinbefore.

Figure 13:
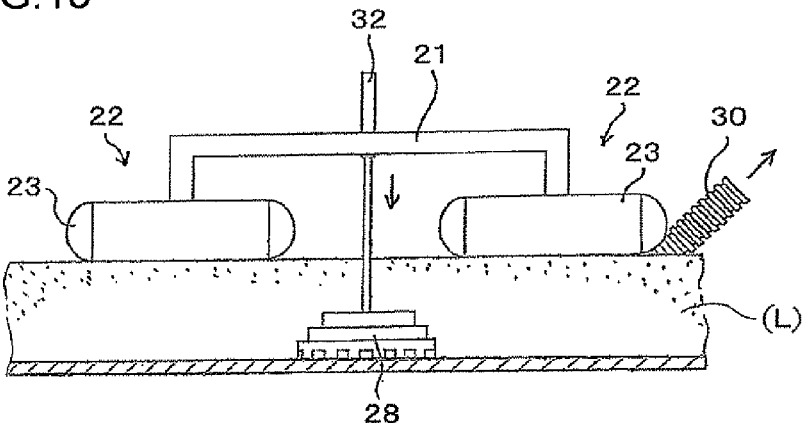
FIG. 13 illustrates a front view showing a state of sucking the sludge liquid by lowering, to the bottom of the sludge storage tank, the suction head of the residual radioactive sludge suction apparatus according to the other embodiment of present invention.

In the case when the residual sludge liquid (L) is sucked under the state in which the surface level of the residual sludge liquid (L) lowers, as shown in FIG. 13, the cylinder 32 is actuated to lower the suction head 28 till the suction head 28 abuts against the bottom portion of the sludge storage tank T1. According to such operation, since the position of the suction apparatus body 21 is fixed, the suctioning of the residual sludge liquid (L) can be sucked at the fixed position.

All the above mentioned operations will be performed by remote control or remote operate manner.

According to the residual sludge liquid suction apparatus of this other embodiment of the present invention, by the manners mentioned above, the residual sludge liquid (L) stored in the sludge storage tank T1 can be sucked and then transferred into the transfer tank, not shown, with no fear of being exposed to the radiation.

REFERENCE NUMERAL

T1 - - - sludge storage tank
T2 - - - transfer tank
L - - - residual sludge liquid
S - - - inner space
1 - - - suction apparatus body
2 - - - hover skirt
3 - - - rubber tube
4 - - - flat plate
5 - - - plug
6 - - - air tube
7 - - - cylinder
8 - - - suction head
9 - - - suction pump
10 - - - suction pipe
12 - - - cylinder
13 - - - air jetting nozzle
14 - - - air tube
21 - - - suction apparatus body
22 - - - floating body
23 - - - rubber tube
24 - - - closing plate
25 - - - plug
26 - - - air tube
27 - - - floating member
28 - - - suction head
29 - - - suction pump
30 - - - suction pipe
32 - - - cylinder
33 - - - air jetting nozzle
34 - - - air tube
41 - - - sludge
42 - - - supernatant solution
43 - - - air blowing device
44 - - - air supply source
45 - - - air pipe
46 - - - air nozzle
47 - - - sludge liquid
48 - - - sludge liquid transfer path
49 - - - supernatant solution transfer path
50 - - - supernatant solution jetting device
51 - - - supernatant solution pipe
52 - - - supernatant solution jetting nozzle
53 - - - inspection port
54 - - - radiation shielding means
55 - - - monitor camera
56 - - - monitor camera
57 - - - control device

The invention claimed is:

1. A residual radioactive sludge liquid suction apparatus that sucks residual sludge liquid at a time when the residual sludge liquid remaining in one tank is transferred to another tank, comprising:

a suction apparatus body;

a plurality of hover skirts mounted to the suction apparatus body;

a suction head mounted to the suction apparatus body and configured to suck the residual sludge liquid;

air jetting nozzles mounted to the hover skirts, respectively; and an air supply source that supplies air to the hover skirts and the air jetting nozzles, wherein:

the suction apparatus body floats on a surface of the residual sludge liquid by supplying the air from the air supply source to the hover skirts, and is propelled on the surface of the residual sludge liquid by jetting the air from the air supply source through the air jetting nozzles;

the hover skirts are inclined toward the suction head side; and a plurality of the hover skirts includes at least three hover skirts that are arranged to apexes constituting a polygonal shape, and the suction head is surrounded by the at least three hover skirts.

2. The residual radioactive sludge liquid suction apparatus according to claim 1, wherein the suction head is vertically movable.

3. A residual radioactive sludge liquid suction apparatus that sucks residual sludge liquid at a time when the residual sludge liquid remaining in one tank is transferred to another tank, comprising:

a suction apparatus body;

a plurality of floating bodies mounted to the suction apparatus body;

a suction head mounted to the suction apparatus body and configured to suck the residual sludge liquid;

air jetting nozzles mounted to the floating bodies, respectively; and an air supply source that supplies air to the air jetting nozzles, wherein:

the suction apparatus body floats on a surface of the residual sludge liquid by floating force of the floating bodies, and is propelled on the surface of the residual sludge liquid by jetting the air from the air supply source through the air jetting nozzles;

the floating bodies are inclined toward the suction head side; and a plurality of the floating bodies includes at least three floating bodies that are arranged to apexes constituting a polygonal shape, and the suction head is surrounded by the at least three floating bodies.

4. The residual radioactive sludge liquid suction apparatus according to claim 3, wherein each of the floating bodies comprises a ring-shaped air tube and a floating member provided in a space surrounded by the ring-shaped air tube.

5. The residual radioactive sludge liquid suction apparatus according to claim 3, wherein the floating member is made of foamed polystyrene.

6. The residual radioactive sludge liquid suction apparatus according to claim 3, wherein the suction head is vertically movable.

* * * * *